United States Patent [19]

Adams

[11] Patent Number: 4,875,301

[45] Date of Patent: Oct. 24, 1989

[54] CYLINDERICAL APPARATUS FOR HOLDING TABLE SKIRTING FOR WRINKLE REMOVAL

[76] Inventor: Charles A. Adams, 3760 Sherbrook Ct., College Park, Ga. 30349

[21] Appl. No.: 244,282

[22] Filed: Sep. 15, 1988

[51] Int. Cl.[4] ..... D06F 69/00; D06F 73/00

[52] U.S. Cl. ..... 38/14; 38/73; 38/75; 38/77.6; 26/90; 223/70

[58] Field of Search ..... 68/8; 26/99, 90; 34/115; 38/14, 77.6, 76, 75, 44, 52, 53, 51, 73; 223/73, 28, 35, 39, 42, 52, 70

[56] References Cited

U.S. PATENT DOCUMENTS

| | | | |
|---|---|---|---|
| 573,095 | 12/1896 | MacKinney | 26/90 |
| 785,822 | 3/1905 | Mitchem | 38/73 X |
| 971,123 | 9/1910 | Durrant | 26/90 |
| 1,113,055 | 10/1914 | Sauerwald | 38/73 |
| 1,429,976 | 9/1922 | Shampay . | |
| 1,749,564 | 3/1930 | Cohen | 38/14 |
| 1,833,625 | 11/1931 | Verardo et al. | 38/14 |
| 2,436,255 | 2/1948 | Glover . | |
| 2,443,557 | 6/1948 | Fitpold . | |
| 2,679,956 | 6/1954 | Richterkessing . | |
| 2,689,996 | 9/1954 | Glattes . | |
| 3,297,216 | 1/1967 | Radford | 223/73 |
| 3,439,847 | 4/1969 | Swain . | |
| 3,620,051 | 11/1971 | Riedel | 34/115 X |
| 3,726,450 | 4/1973 | Richterkessing . | |
| 3,823,497 | 7/1974 | Solomon | 38/77.6 |
| 4,173,300 | 11/1979 | Sanko . | |
| 4,303,183 | 12/1981 | Schlemon . | |

*Primary Examiner*—Andrew M. Falik
*Attorney, Agent, or Firm*—Needle & Rosenberg

[57] ABSTRACT

A method and apparatus for removing wrinkles from a table skirt includes a cylinder capable of holding the table skirt and having a porous portion. The apparatus further includes devices for rotating the cylinder and for delivering steam from an outside source through the cylinder so that the steam passes through the porous portion and removes the wrinkles.

12 Claims, 2 Drawing Sheets

CYLINDERICAL APPARATUS FOR HOLDING TABLE SKIRTING FOR WRINKLE REMOVAL

BACKGROUND OF THE INVENTION

The present invention relates to the laundering industry, and more particularly to an apparatus for removing wrinkles from table skirting.

Table skirtings are long pieces of material used to cover banquet tables at restaurants, hotels, and elsewhere. These skirtings must be cleaned after each use. After each washing, the skirts must be ironed so that wrinkles can be removed. However, a problem exists in that the skirts are typically long (i.e. ten to twenty feet) and pleated. This creates handling difficulties during ironing, and as a result increases the cost of the laundering process. Therefore, there exists a need for a device which removes wrinkles from table skirting and similarly configured pieces of cloth quickly and effectively.

SUMMARY OF THE INVENTION

An apparatus for removing wrinkles from table skirting is provided. The apparatus includes a light-weight metal cylinder which rotates by means of a motor and drive-wheel assembly mounted at the bottom portion of the cylinder. Means for applying steam to the cylinder are also provided, as are means for removing steam or water vapor from the device after use. Means for applying hot air to the cylinder and are also included. Also, an on/off switch for controlling the flow of the steam and hot air are provided, as well as means for controlling the speed and direction of rotation of the cylinder. A shield is provided on the lower portion of the cylinder for forcing steam to a porous portion of the cylinder during operation. Also provided is a solid top portion, or "cap" for holding steam in the cylinder.

In operation, as the cylinder slowly rotates, the skirting is wrapped around the cylinder and clipped to its top portion. After the skirt is in place, steam or water vapor is applied through the cylinder and the skirting is lightly brushed with a broom or similar device to remove wrinkles. The skirting is then blown dry with warm air and removed from the cylinder and placed on a hanger for storage. It should be seen that the present invention eliminates much of the handling herebefore associated with ironing table skirting.

A second embodiment of this invention relates to the rotating cylinder without the means for applying stream. Although steam is preferred for removing the wrinkles, device without steam would be acceptable.

It is an object of the present invention, therefore, to provide an apparatus which removes wrinkles from table skirting and similar pieces of cloth quickly and efficiently. These and other objects and advantages of the invention will become more apparent from the following detailed description, in which like numbers represent like elements throughout the views.

DETAILED DESCRIPTION OF THE INVENTION

Figure 1:
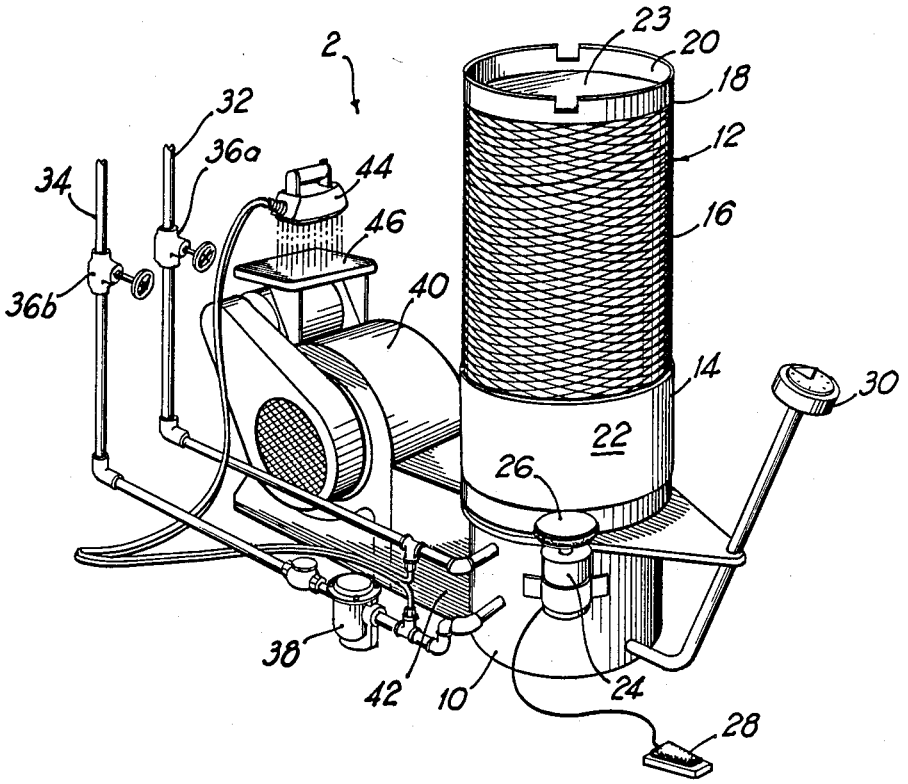
FIG. 1 is a perspective view of an apparatus for removing wrinkles from table skirting according to the present invention.
Figure 2:
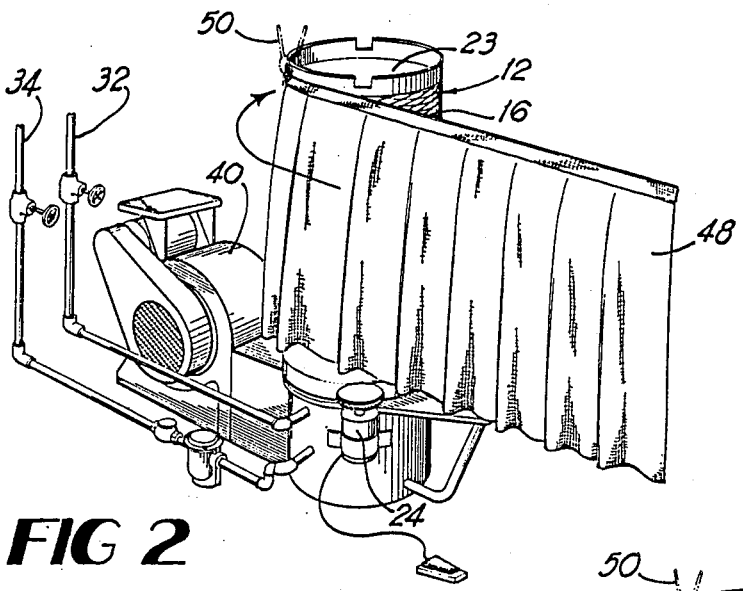
FIG. 2 is a perspective view of an apparatus for removing wrinkles from table skirting according to the present invention having a table skirting being applied thereto.
Figure 3:
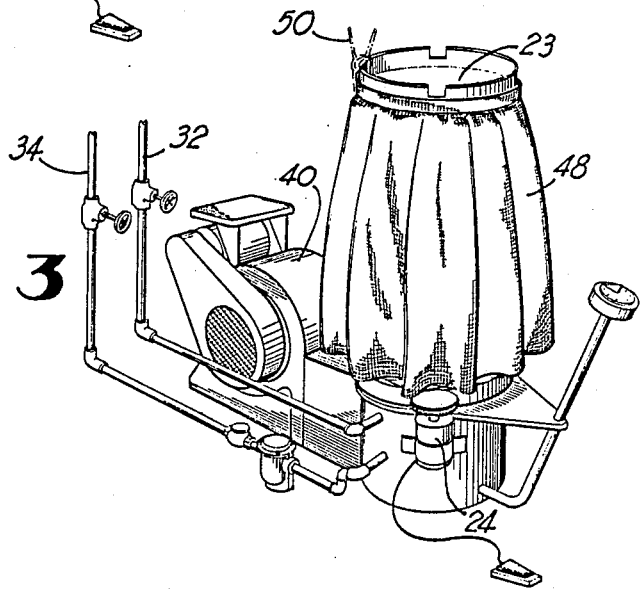
FIG. 3 is a perspective view of an apparatus for removing wrinkles from table skirting according to the present invention having a table skirt clipped thereto.

Referring to FIGS. 1–3, the apparatus 2 for removing wrinkles from table skirting comprises a supporting base 10 having an upwardly extending cylinder 12 rotatably mounted thereon. The cylinder 12 has a bottom portion 14, and an upper portion 16. Surrounding the top periphery 18 of the cylinder 12 is an upper flange 20. Located at the bottom portion 14 of the cylinder 12 is a solid shield 22 for directing steam to the upper portion 16. The upper portion 16 is mesh-like or otherwise holed to allow steam to escape therethrough. Furthermore, a solid top cap 23 is provided within the circumference of the upper portion 18 of the cylinder 12 for maintaining steam within the cylinder 12, as discussed more fully below.

A motor 24 is attached to the base 10 for powering a drive-wheel 26, which in turn contacts and rotates the cylinder 12. Means for turning the motor on and off 28 are also provided, preferably in the form of a foot pedal which frees the hands of the operator during operation. Means for controlling the speed of rotation of the cylinder 30 are also provided so that the rotation of the cylinder 12 can be adapted to the skill of the operator. Furthermore, means for controlling the direction of rotation of the cylinder 12 are provided so that the apparatus may be used by left-handed and right-handed operators without difficulty.

Means for delivering steam to the cylinder 12 for removing wrinkles from the table skirt are provided, preferably in the form of steam inlet pipe 32 connected at a first end to an outside source of steam (not shown) and at a second end to the base 10. Means for removing wet steam and condensate from the apparatus are preferably in the form of an outlet pipe 34 communicating at a first end to the lower end of the cylinder 12 and extending to an outside depository (not shown). Located on each pipe 32 and 34 are control valves 36*a,b* for controlling steam pressure to and from the apparatus and strainers 3 for trapping debris. Also provided are means for introducing hot air to the cylinder for drying the table skirt, as discussed more fully below. The hot air introduction means are preferably a blower 40 deliverably connected to the base 10 and cylinder 12 through conduit 42.

Optionally, as shown in FIG. 1, a steam iron 44 may be provided receiving steam from outlet pipe 34 and delivering condensate to outlet pipe 34. Also, an iron supporting stand 46 may be included for holding the iron 44 when not in use. Also, the means for delivering steam may be omitted, such as when portability of the device is desired.

In operation, as seen in FIGS. 2 and 3 the motor 24 is turned on and the cylinder 12 rotates. A table skirt 48 is clipped onto the upper flange 20 by clips 50 or some other similar means. The rotation of the cylinder 12 allows the table skirt to be easily wrapped and clipped around the cylinder 12, as shown in FIG. 2. Once the skirt 48 is in place, steam or water vapor is applied through the cylinder 12 from inlet pipe 32. The steam is directed to the upper portion 16 of the cylinder 12 by the shield 22 and cap 23, and exits through the mesh, thereby aiding in the wrinkle removal process. The steamed skirt 48 is then brushed by a broom, iron, or other means to remove wrinkles. This brushing is made easy by the rotation of the skirt 48 in front of a stationary operator. Once this operation is completed, hot air is delivered to the cylinder from blow 40 to dry the skirt 48 and the remaining wet steam and condensate is removed from the apparatus through outlet pipe 34.

What is claimed is:

1. An apparatus for removing wrinkles from a table skirt comprising:

(a) a vertically oriented cylinder capable of holding a table skirt and being porous along a portion of its length;

(b) means for rotating said cylinder whereby a table skirt may be wound around said cylinder in an overlapping manner;

(c) a flange provided on the upper portion of said cylinder;

(d) clipping means capable of clipping said table skirt to said flange and around said cylinder in an overlapping manner as said cylinder rotates; and (e) means for delivering steam from an outside source through said porous portion of said cylinder for removing the wrinkles from said wound table skirt.

2. The apparatus of claim 1, wherein said porous portion is located at the upper portion along the length of said cylinder.

3. The apparatus of claim 1, and further comprising means for directing steam to the porous portion of said cylinder.

4. The apparatus of claim 1, wherein said cylinder has an elongated shape along its longitudinal axis and wherein said steam delivering means delivers steam to a lower cylinder portion located below said porous section and further comprising a shield for directing steam to said porous section of said cylinder during the removal process.

5. The apparatus of claim 1, and further comprising a cap located in the circumference of the upper portion of said cylinder for maintaining steam within said cylinder during the removal process.

6. The apparatus of claim 1, and further comprising drying means for drying said table skirt while said table skirt is held onto said cylinder.

7. The apparatus of claim 6, wherein said drying means comprises a blower capable of delivering air through said cylinder.

8. The apparatus of claim 1 wherein said means for rotating said cylinder comprise a motor and a drive-wheel powered by said motor and contacting said cylinder to rotate said cylinder.

9. The apparatus of claim 1, and further comprising means for controlling the direction of rotation of said cylinder.

10. The apparatus of claim 1, and further comprising means for controlling the speed of rotation of said cylinder.

11. The apparatus of claim 1, and further comprising a steam iron capable of receiving steam from said means for delivering steam through said cylinder.

12. An apparatus for holding a table skirt while removing wrinkles from the table skirt using an iron or brush comprising:

(a) a vertically oriented cylinder capable of holding a table skirt;

(b) means for rotating said cylinder so that said table skirt may be wound around said cylinder in an overlapping manner as said cylinder rotates for facilitating ironing or brushing;

(c) a flange provided on the upper portion of said cylinder; and (d) clipping means capable for clipping said table skirt to said flange and around said cylinder in an overlapping manner as said cylinder rotates.

* * * * *